US012007144B2

(12) United States Patent
Cho et al.

(10) Patent No.: US 12,007,144 B2
(45) Date of Patent: Jun. 11, 2024

(54) VENTILATION APPARATUS AND AIR CONDITIONER INCLUDING THE SAME

(71) Applicant: Samsung Electronics Co., Ltd., Suwon-si (KR)

(72) Inventors: Sungjune Cho, Suwon-si (KR); Hyungmo Koo, Suwon-si (KR); Youjae Kim, Suwon-si (KR); Joonhyoung Kim, Suwon-si (KR); Hyunah Kim, Suwon-si (KR); Seonuk Na, Suwon-si (KR); Jaehyoung Sim, Suwon-si (KR); Eomji Jang, Suwon-si (KR); Dongho Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 454 days.

(21) Appl. No.: 17/087,922

(22) Filed: Nov. 3, 2020

(65) Prior Publication Data

US 2021/0140658 A1 May 13, 2021

(30) Foreign Application Priority Data

Nov. 8, 2019 (KR) ..... 10-2019-0142446

(51) Int. Cl.
*F24F 7/10* (2006.01)
*F24F 1/0035* (2019.01)
(Continued)

(52) U.S. Cl.
CPC ..... *F24F 7/10* (2013.01); *F24F 1/0035* (2019.02); *F24F 13/20* (2013.01); *F24F 13/28* (2013.01);
(Continued)

(58) Field of Classification Search
CPC ..... F24F 1/0035; F24F 1/0033; F24F 1/0073; F24F 7/10; F24F 13/0218; F24F 13/20; F24F 13/30; F24F 13/28; F24F 2013/205
(Continued)

(56) References Cited

U.S. PATENT DOCUMENTS 4,157,902 A * 6/1979 Tokar ..... F02M 35/10262 55/327
6,849,100 B2 * 2/2005 Lim ..... F24F 3/167 55/482
(Continued)

FOREIGN PATENT DOCUMENTS

CN 105157151 B * 11/2017
CN 209588257 11/2019
(Continued)

OTHER PUBLICATIONS

International Search Report dated Feb. 22, 2021 in International Patent Application No. PCT/KR2020/014811.

*Primary Examiner* — Allen R. B. Schult
(74) *Attorney, Agent, or Firm* — STAAS & HALSEY LLP

(57) ABSTRACT

Disclosed are a ventilation apparatus and an air conditioner including the same. The air conditioner includes a main body including a heat exchanger and a blower fan blowing indoor air to pass through the heat exchanger, and a ventilation apparatus mounted on the main body to ventilate a room, the ventilation apparatus includes a case configured to accommodate a ventilation fan, a ventilation pipe including an inlet tube mounted on an outdoor air inlet of a building and an extension tube connecting a flow path of the case and the inlet tube and detachably connected to the inlet tube, and a ventilation filter installed in the ventilation pipe through a
(Continued)

connection portion between the inlet tube and the extension tube to filter out foreign substances in air.

19 Claims, 15 Drawing Sheets

(51) Int. Cl.
*F24F 13/20* (2006.01)
*F24F 13/28* (2006.01)
*F24F 13/30* (2006.01)

(52) U.S. Cl.
CPC ..... *F24F 13/30* (2013.01); *F24F 2013/205* (2013.01)

(58) Field of Classification Search
USPC ..... 454/186
See application file for complete search history.

(56) References Cited

U.S. PATENT DOCUMENTS

| | | | | |
|---|---|---|---|---|
| 2005/0184509 | A1* | 8/2005 | Crook | F16L 35/00 285/24 |
| 2018/0085695 | A1 | 3/2018 | Wall et al. | |
| 2019/0101298 | A1* | 4/2019 | Adams | F24F 1/0035 |

FOREIGN PATENT DOCUMENTS

| | | | | |
|---|---|---|---|---|
| JP | 2005-106401 | | 4/2005 | |
| KR | 10-2005-0060385 | | 6/2005 | |
| KR | 10-0529917 | | 11/2005 | |
| KR | 10-0946791 | | 3/2010 | |
| KR | 977570 | B1 * | 8/2010 | F24F 1/0003 |
| KR | 10-1672673 | | 11/2016 | |
| KR | 10-1711148 | | 3/2017 | |
| KR | 10-1893580 | | 10/2018 | |

* cited by examiner

VENTILATION APPARATUS AND AIR CONDITIONER INCLUDING THE SAME

CROSS-REFERENCE TO RELATED APPLICATION(S)

This application is based on and claims priority under 35 U.S.C. § 119 to Korean Patent Application No. 10-2019-0142446, filed on Nov. 8, 2019, in the Korean Intellectual Property Office, the disclosure of which is incorporated by reference herein in its entirety.

BACKGROUND

1. Field

The disclosure relates to a ventilation apparatus and an air conditioner including the same.

2. Description of Related Art

An air conditioner is an apparatus that keeps the indoor environment in a comfortable state through cooling, heating, and air purification.

In general, when an air conditioner is operated, the inflow of outdoor air is blocked by closing a window to prevent energy loss. However, when this environment is maintained for a long time, indoor air is contaminated not only by carbon dioxide, body odor, and dust generated by occupants' activities but also by combustion gas generated during a cooking process. Therefore, recently, an air conditioner equipped with a ventilation apparatus is used or a separate ventilation apparatus is installed indoors.

A ventilation apparatus includes a main body having a ventilation fan, a ventilation pipe that connects the main body and an outdoor air inlet formed on a building wall and guides the inflow of outdoor air, and a filter for filtering dust and the like contained in outdoor air.

However, because this ventilation apparatus has a filter built into the main body, an inner surface of the ventilation pipe may be contaminated by dust in the process of introducing outdoor air into the main body, and maintenance such as cleaning or replacement of the filter may be cumbersome.

SUMMARY

In accordance with an aspect of the disclosure, an air conditioner includes a main body including a heat exchanger and a blower fan blowing indoor air to pass through the heat exchanger, and a ventilation apparatus mounted on the main body to ventilate a room, wherein the ventilation apparatus includes a case configured to accommodate a ventilation fan, a ventilation pipe including an inlet tube mounted on an outdoor air inlet of a building and an extension tube connecting a flow path of the case and the inlet tube and detachably connected to the inlet tube, and a ventilation filter installed in the ventilation pipe through a connection portion between the inlet tube and the extension tube to filter out foreign substances in air.

The ventilation filter may include a support part supported on the connection portion between the inlet tube and the extension tube, and an air filtering part extending in a flow direction of air from the support part and provided in a cup shape.

The air filtering part gradually may decrease in diameter toward the flow direction of air from the support part.

The extension tube may be provided as a flexible tube, and the air filtering part may include a plurality of support ribs extending radially from an outer surface thereof to be supported on an inner surface of the extension tube.

The air filtering part may have a length longer than an inner diameter of the extension tube.

The ventilation apparatus may further include a first connector provided at an end of the inlet tube, and a second connector provided at an end of the extension tube to be connected to the first connector.

The support part may be interposed between the first connector and the second connector.

The extension tube may be provided as a flexible tube, and the ventilation apparatus may further include a protective tube provided outside the extension tube to prevent deformation of the extension tube outside the air filtering part and connected to the second connector.

The air filtering part may have pleats formed in a circumferential direction so that a plurality of valleys is formed in a lengthwise direction.

The ventilation filter may be installed such that the air filtering part is inserted into the extension tube.

The ventilation filter may be installed such that the air filtering part is inserted into the inlet tube.

The ventilation filter may include a first ventilation filter installed such that the air filtering part is inserted into the inlet tube, and a second ventilation filter installed such that the air filtering part is inserted into the extension tube.

The inlet tube may include an opening/closing device configured to open and close a flow path therein.

In accordance with another aspect of the disclosure, an air conditioner includes a main body including a heat exchanger and a blower fan blowing indoor air to pass through the heat exchanger, and a ventilation apparatus mounted on the main body to ventilate a room, wherein the ventilation apparatus includes a case configured to accommodate a ventilation fan, a ventilation pipe configured to connect an outdoor air inlet of a building and a flow path of the case, and a ventilation filter including a cup-shaped air filtering part having an opening side supported in the ventilation pipe and extending in a flow direction of air in the ventilation pipe.

In accordance with another aspect of the disclosure, a ventilation apparatus includes a ventilation fan configured to suck outdoor air to be supplied to a room, a case configured to accommodate the ventilation fan and provided with a flow path connected to the ventilation fan therein, a ventilation pipe including an inlet tube mounted on an outdoor air inlet of a building and an extension tube connecting the flow path of the case and the inlet tube and detachably connected to the inlet tube, and a ventilation filter installed in the ventilation pipe through a connection portion between the inlet tube and the extension tube to filter out foreign substances in air.

In accordance with another aspect of the disclosure, a ventilation apparatus includes a ventilation fan configured to suck outdoor air to be supplied to a room, a case configured to accommodate the ventilation fan and provided with a flow path connected to the ventilation fan therein, a ventilation pipe configured to connect an outdoor air inlet of a building and the flow path of the case, and a ventilation filter including a cup-shaped air filtering part having an opening side supported in the ventilation pipe and extending in a flow direction of air in the ventilation pipe.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Configurations shown in the embodiments and the drawings described in the present specification are only the preferred embodiments of the present disclosure, and thus it is to be understood that various modified examples, which may replace the embodiments and the drawings described in the present specification, are possible when filing the present application.

The singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that although the terms first, second, etc. may be used herein to describe various components regardless of importance or order, these components should not be limited by these terms, and the terms are only used to distinguish one component from another without limiting the components.

It is an aspect of the disclosure to provide a ventilation apparatus capable of minimizing contamination of a ventilation pipe, and an air conditioner including the same.

It is another aspect of the disclosure to provide a ventilation apparatus capable of minimizing a volume of a filter, improving a dust collection capacity and facilitating maintenance of the filter, and an air conditioner including the same.

Hereinafter, embodiments of the disclosure will be described in detail with reference to the accompanying drawings.

Figure 1:
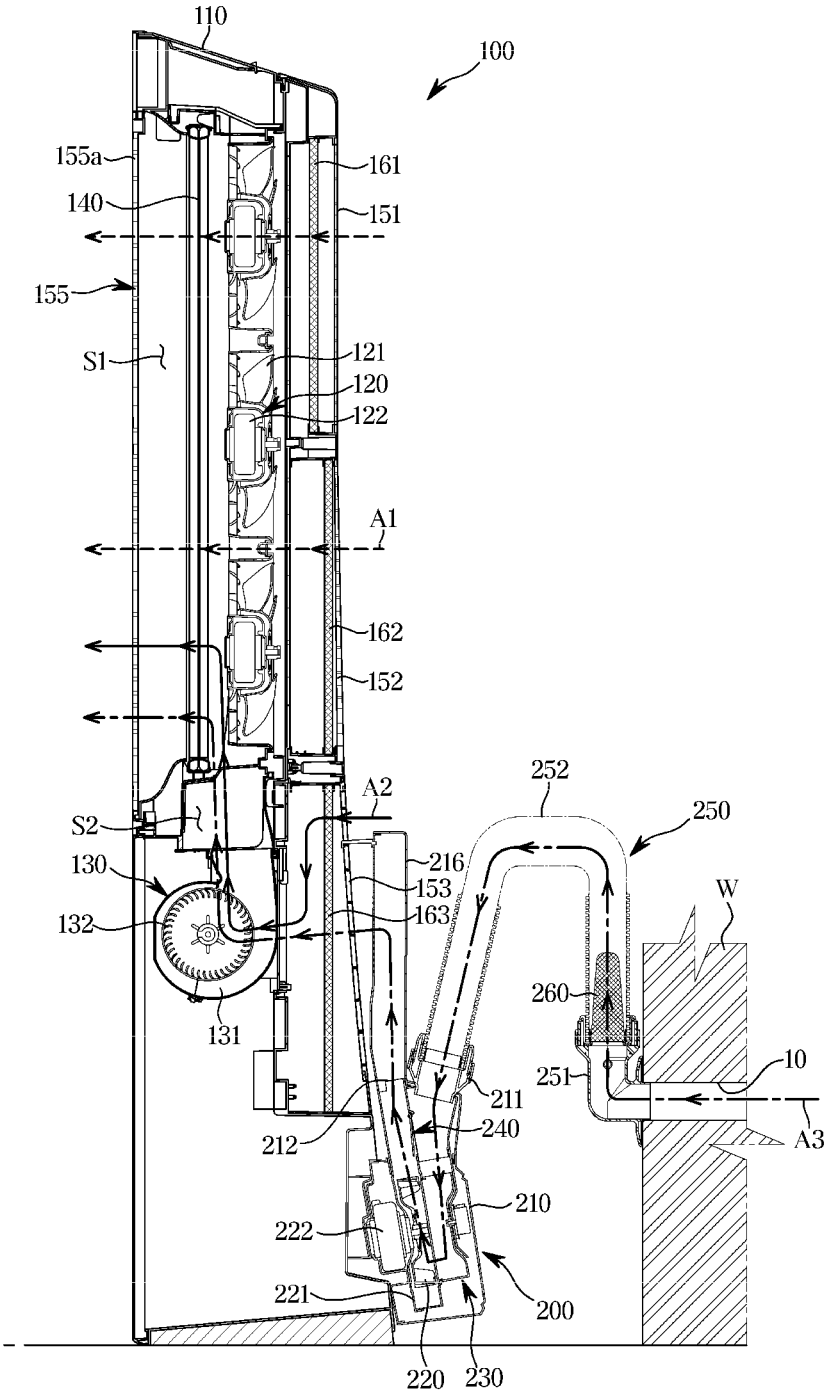
FIG. 1 is a longitudinal cross-sectional view of an air conditioner to which a ventilation apparatus according to an embodiment of the disclosure is applied.
Figure 2:
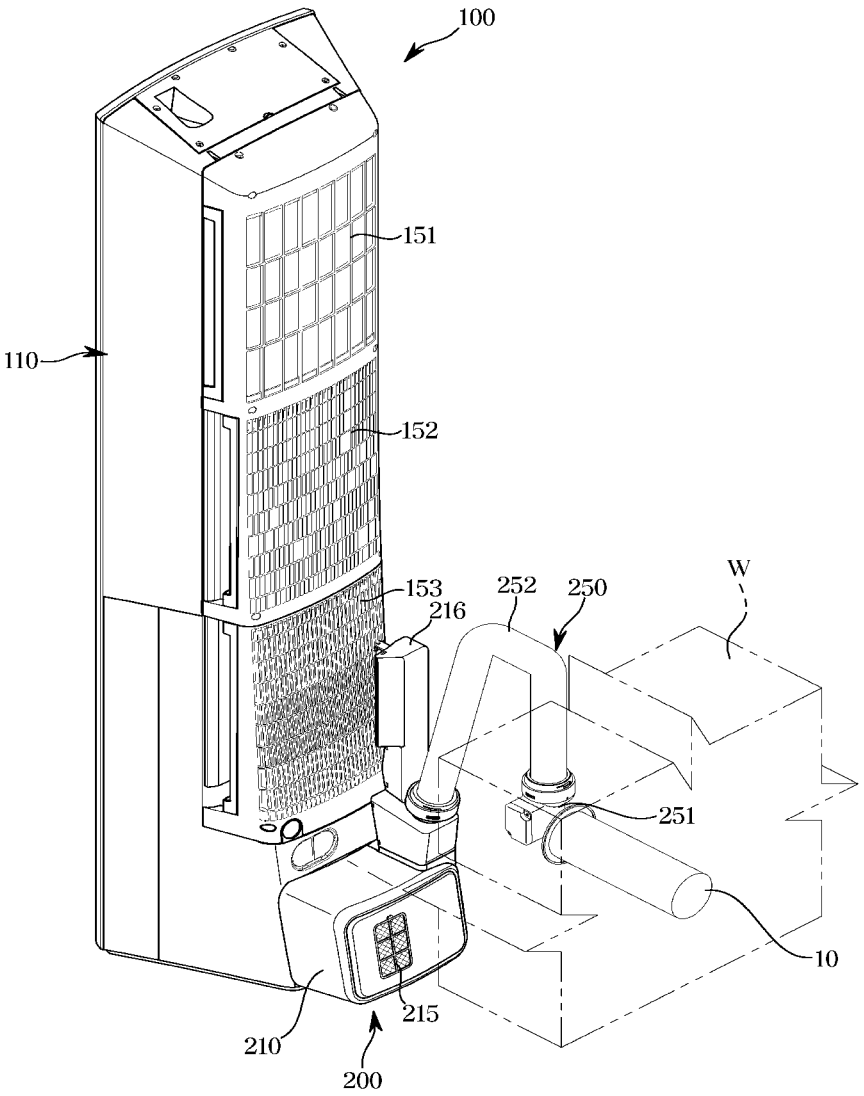
FIG. 2 is a rear perspective view of the air conditioner to which the ventilation apparatus according to an embodiment of the disclosure is applied.
Figure 3:
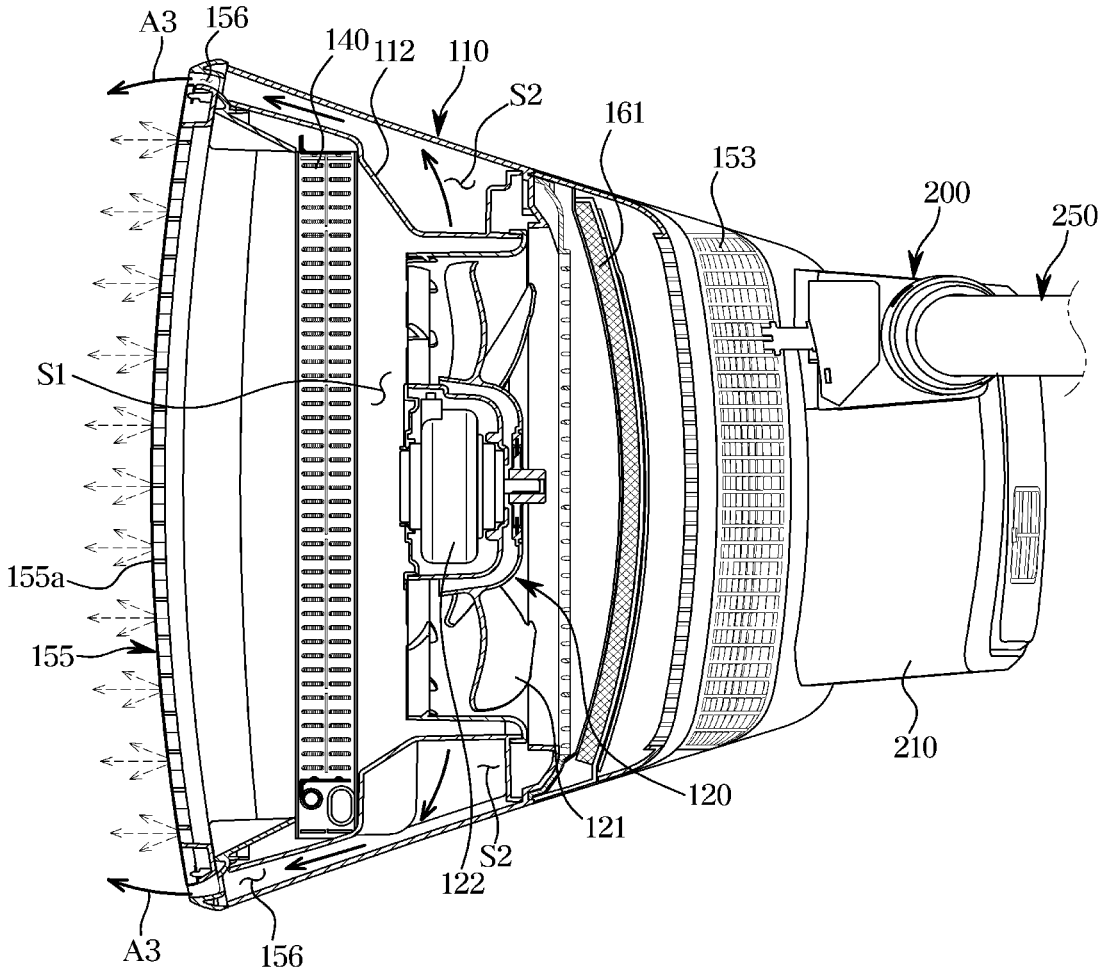
FIG. 3 is a transverse cross-sectional view of the air conditioner to which the ventilation apparatus according to an embodiment of the disclosure is applied.

Referring to FIGS. 1 to 3, an air conditioner includes main body 100, a ventilation apparatus 200 installed in the rear of the main body 100.

The main body 100 may be disposed inside a room to suck indoor air for heat exchange and discharge the heat-exchanged air to the room. Unlike the present embodiment, the main body 100 may be disposed outside a room to suck outdoor air for heat exchange and discharge the heat-exchanged air to the outside.

The main body 100 may include a box-shaped housing 110 having a long length in a vertical direction, a plurality of first blowing devices 120, a second blowing device 130, and a heat exchanger 140, which are arranged inside the housing 110.

The housing 110 includes a first suction port 151 provided on an upper side of a rear surface thereof, a second suction port 152 provided on a middle portion of the rear surface in the vertical direction, a third suction port 153 provided on a lower side of the rear surface, a first discharge port 155 provided on an upper side of a front surface thereof, and second discharge ports 156 provided on opposite sides of the first discharge port 155 of the front surface.

As illustrated in FIG. 3, the first discharge port 155 may include a plurality of discharge holes 155*a* formed on the front surface of the housing 110. Accordingly, air guided to the first discharge port 155 may be discharged to the outside of the housing 110 after a speed thereof is reduced while passing through the plurality of discharge holes 155*a*. The plurality of discharge holes 155*a* is provided with a fine size and may be evenly distributed in an upper front region of the housing 110. Air discharged through the plurality of discharge holes 155*a* does not directly reach a user and may gradually cool or heat a room.

Inside the housing 110, a first flow path S1 to allow air A1 flown into the first suction port 151 and the second suction port 152 of the rear surface to be discharged to the first discharge port of the front surface, and a second flow path S2 to allow air A2 flown into the third suction port 153 of the rear surface to be discharged to the second discharge ports 156 (see FIG. 3) of the opposite sides of the front surface may be provided.

The first flow path S1 and the second flow path S2 may be partitioned from each other in the housing 110 by a partition plate 112. Accordingly, the air A1 flowing through the first flow path S1 and the air A2 flowing through the second flow path S2 are not basically mixed with each other in the housing 110. However, as necessary, the first flow path S1 and the second flow path S2 may be partially communicated within the housing 110 so that a part of air in the first flow path S1 and a part of air in the second flow path S2 may be mixed.

The plurality of first blowing devices 120 may be installed in a row in the vertical direction within the first flow path S1. The plurality of first blowing devices 120 sucks air from the first suction port 151 and the second suction port 152 of the rear surface and discharges the air to the first discharge port 155 of the front surface. The plurality of first blowing devices 120 may each include a first blowing fan 121 and a first motor 122 driving the first blowing fan 121.

The heat exchanger 140 may be installed in front of the plurality of first blowing devices 120 disposed in the first flow path S1. Accordingly, air blown by the plurality of first blowing devices 120 may be heat-exchanged while passing through the heat exchanger 140 and then discharged to the first discharge port 155 of the front surface. When indoor cooling or heating is performed, the plurality of first blowing devices 120 may operate to allow indoor air to flow through the first flow path S1.

The second blowing device 130 may be installed in the second flow path S2 in an inner lower region of the housing 110. The second blowing device 130 may include a fan case 131 connected to the second flow path S2, a second blowing fan 132, and a second motor (not shown) driving the second blowing fan 132. The second blowing device 130 may operate independently of the operation of the first blowing devices 120 or may operate together with the first blowing devices 120.

When the second blowing device 130 operates, the air A2 sucked through the third suction port 153 may be discharged to the second discharge port 156 through the second flow path S2 inside the housing 110. The second blowing device 130 may operate independently of the first blowing devices 120 to circulate indoor air regardless of a cooling or heating operation. The second blowing device 130 may also operate together with the first blowing devices 120 to circulate indoor air together with indoor cooling or heating.

A first filter 161 and a second filter 162 configured to filter out foreign substances contained in the air A1 sucked for cooling or heating may be installed inside the first suction port 151 and the second suction port 152, respectively. The first filter 161 and the second filter 162 may each include an electric dust collecting filter, a HEPA filter, an antibacterial filter, a deodorizing filter, and the like.

A third filter 163 configured to filter out foreign substances contained in the air A2 sucked for circulation may be installed inside the third suction port 153. Similarly, the third filter 163 may include an electric dust collecting filter, a HEPA filter, an antibacterial filter, a deodorizing filter, and the like.

The ventilation apparatus 200 may ventilate a room by introducing outdoor air into the room or may ventilate a room by discharging indoor air to the outside.

Figure 4:
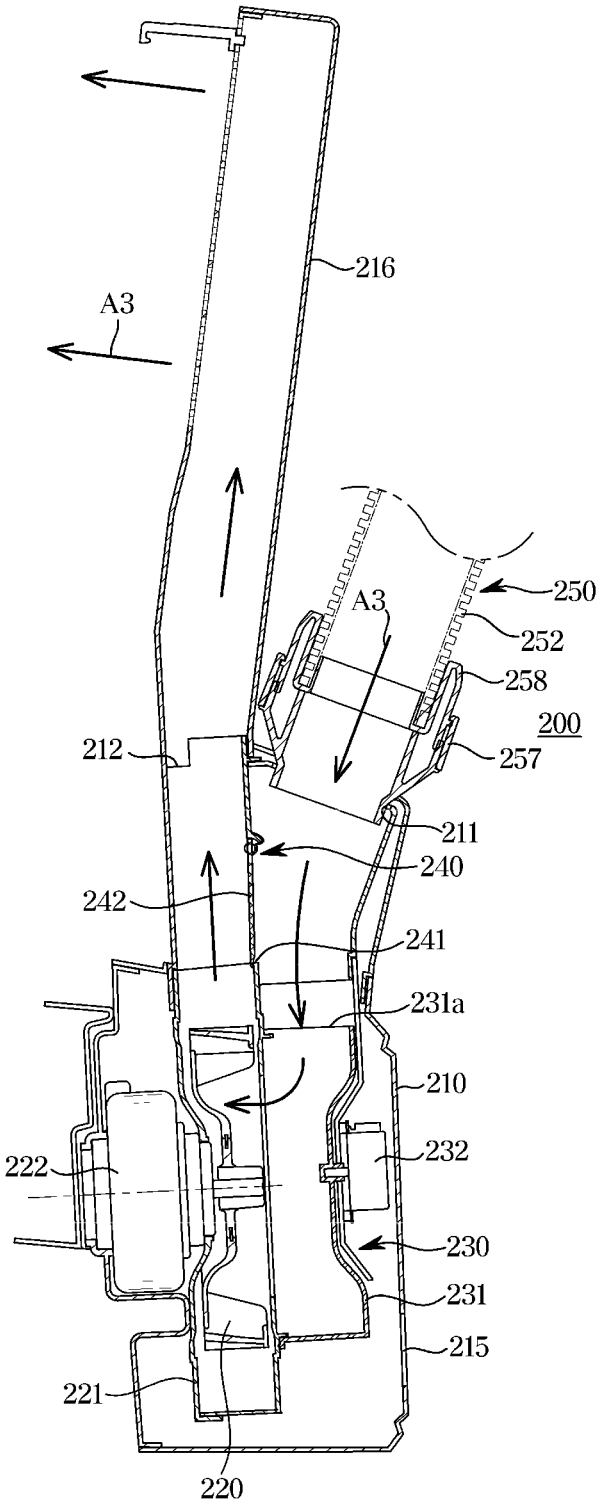
FIG. 4 is a cross-sectional view illustrating an air supply mode of the ventilation apparatus according to an embodiment of the disclosure.

As illustrated in FIGS. 1, 2, and 4, the ventilation apparatus 200 may include a case 210, a ventilation fan 220, a fan case 221, a ventilation motor 222, a first flow path switching device 230, a second flow path switching device 240, a ventilation pipe 250, and a ventilation filter 260.

As illustrated in FIGS. 1 and 2, the case 210 may be mounted on the rear surface of the housing 110 of the main body 100. The case 210 includes an inlet 211 connected to the ventilation pipe 250, and an outlet 212 for discharging air toward the third suction port 153 of the main body 100. The ventilation fan 220, the fan case 221, the ventilation motor 222, the first flow path switching device 230, and the second flow path switching device 240 are accommodated in the case 210.

Figure 5:
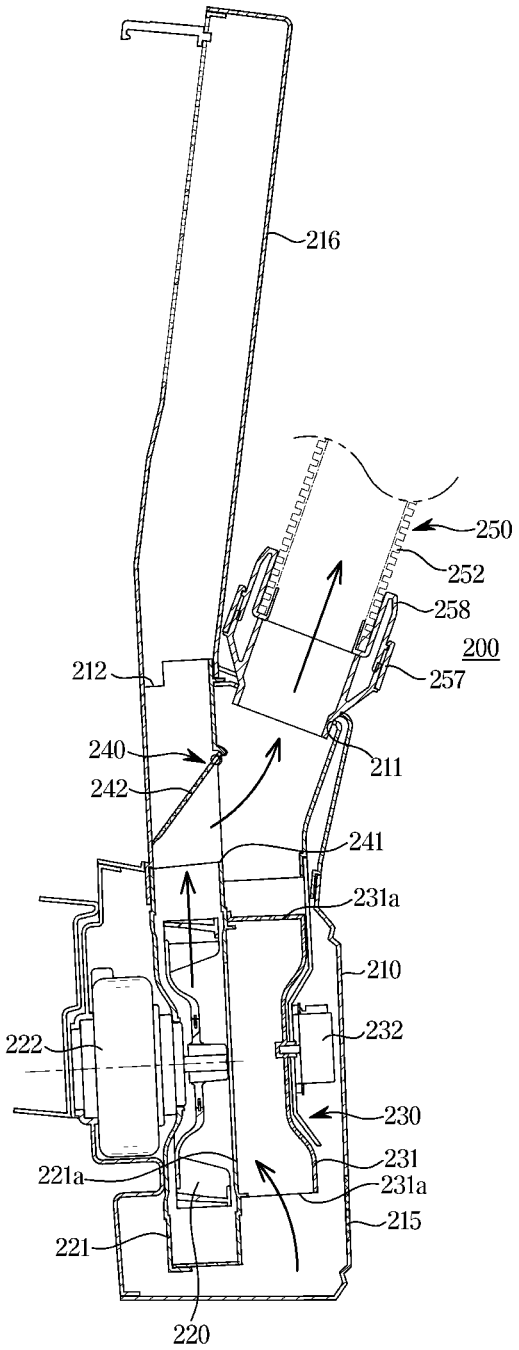
FIG. 5 is a cross-sectional view illustrating an exhaust mode of the ventilation apparatus according to an embodiment of the disclosure.

Referring to FIGS. 4 and 5, the ventilation fan 220 may be a multi-wing type centrifugal fan that sucks air in an axial direction from a central portion thereof and discharges air in a radial direction.

The fan case 221 is installed in the case 210 to accommodate the ventilation fan 220 and forms a flow path connecting the inlet 211 and the outlet 212. The fan case 221 may include a suction port 221*a* formed at a position facing a suction side of the ventilation fan 220 so that the ventilation fan 220 may suck air. The ventilation motor 222 may rotate the ventilation fan 220 in a state of being mounted on an outer surface of the fan case 221 opposite to the suction port 221*a*.

The first flow path switching device 230 may include a cylindrical first flow path switching member 231 rotatably installed on a front surface of the suction port 221*a* of the fan case 221 and having an opening 231*a* in a radial direction thereof, and a first flow path switching driving member 232 configured to rotate the first flow path switching member 231.

As illustrated in FIG. 4, when the first flow path switching device 230 rotates upward such that the opening 231*a* of the flow path switching member 231 is connected to the inlet 211, the first flow path switching device 230 may allow air in the inlet 211 to be introduced into the inlet 221*a* of the fan case 221. As illustrated in FIG. 5, when the first flow path switching device 230 rotates such that the opening 231*a* of the flow path switching member 231 faces downward, the first flow path switching device 230 may block the inlet 211 and the suction port 221*a* of the fan case 221 and may allow indoor air introduced through holes 215 formed on a rear surface of the case 210 to be introduced into the inlet 221*a* of the fan case 221.

The second flow path switching device 240 may include a communication port 241 formed on the fan case 221 to communicate a flow path of the inlet 211 side and a flow path of the outlet 212 on the case 210, a second flow path switching member 242 in the form of a flat plate to switch a flow path so that air discharged by the ventilation fan 220 is discharged to the outlet 212 or to the communication port 241, and a second flow path switching driving member (not shown) configured to drive the second flow path switching member 242.

When the second flow path switching member 242 closes the communication port 241 and opens the outlet 212 as in the example illustrated in FIG. 4, the second flow path switching device 240 may induce air discharged by the ventilation fan 220 to the outlet 212. On the contrary, when the second flow path switching member 242 opens the communication port 241 and closes the outlet 212 as in the example illustrated in FIG. 5, the second flow path switching device 240 may induce air discharged by the ventilation fan 220 to the inlet 211.

The ventilation apparatus 200 as above may perform an air supply mode as illustrated in FIG. 4 and an exhaust mode as illustrated in FIG. 5, by the operations of the first flow path switching device 230 and the second flow path switching device 240.

As illustrated in FIG. 4, in the air supply mode, the ventilation fan 220 may be operated in states in which the first flow path switching device 230 is operated to communicate the inlet 211 and the suction port 221*a* of the fan case 221 and the second flow path switching device 240 is operated to close the communication port 241 and open the outlet 212. Therefore, in the air supply mode, outdoor air A3 may be sucked through the ventilation pipe 250 and discharged into the room.

As illustrated in FIGS. 1 and 3, in the air supply mode, the outdoor air A3 discharged to the outlet 212 of the case 210 may be induced to the third suction port 153 of the main body 100 by a discharge duct 216 extending from the outlet 212 of the case 210. In the air supply mode, the main body 100 may discharge outdoor air sucked into the third suction port 153 by the operation of the second blowing device 130 to the second discharge port 156 through the second flow path S2 inside the housing 110.

As illustrated in FIG. 5, in the exhaust mode, the ventilation fan 220 may be operated in states in which the first flow path switching device 230 is operated to block the inlet 211 and the suction port 221*a* of the fan case 221 and the second flow path switching device 240 is operated to open the communication port 241 and close the outlet 212.

Therefore, in the exhaust mode, indoor air may be sucked and discharged to the outside through the ventilation pipe 250.

Figure 6:
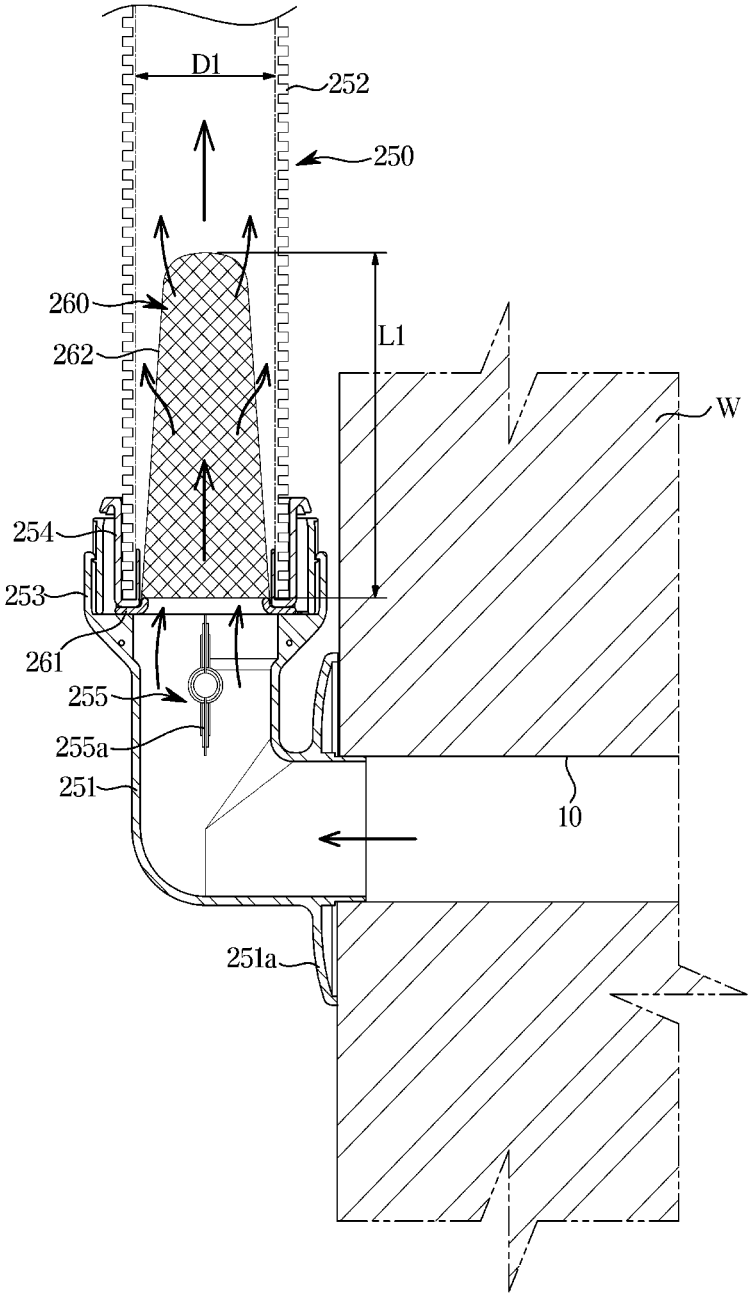
FIG. 6 is a cross-sectional view of a ventilation pipe and a ventilation filter of the ventilation apparatus according to an embodiment of the disclosure.

Referring to FIGS. 1, 4, and 6, the ventilation pipe 250 connects an outdoor air inlet 10 formed on a building wall W and the inlet 211 of the case 210 and may guide the inflow of outdoor air or the discharge of indoor air according to the operation of the ventilation fan 220.

The ventilation pipe 250 includes an inlet tube 251 mounted on the outdoor air inlet 10 of the building wall W, and an extension tube 252 connecting the inlet 211 of the case 210 and the inlet tube 251 and detachably connected to the inlet tube 251. The ventilation filter 260 may filter out foreign substances in air passing through the ventilation pipe 250 in a state of being installed in the ventilation pipe 250 through a connection portion between the inlet tube 251 and the extension tube 252.

As illustrated in FIG. 6, the inlet tube 251 may be formed in a curved pipe shape by injection molding of a resin material. The inlet tube 251 includes a flange-type sealing wing 251*a* provided on an outer surface of one end thereof coupled to the outdoor air inlet 10 to be in close contact with a wall surface. The inlet tube 251 also includes a first connector 253 provided on the opposite end thereof coupled to the extension tube 252 for connection or separation of the extension tube 252.

The present embodiment illustrates that the inlet tube 251 is a curved tube bent substantially by 90 degrees, but the inlet tube 251 may be a straight tube. FIG. 6 illustrates an example in which the first connector 253 of the inlet tube 251 connected to the extension tube 252 faces an upper side, but the first connector 253 may be changed to face a side or a lower side according to the installation of the inlet tube 251.

Figure 7:
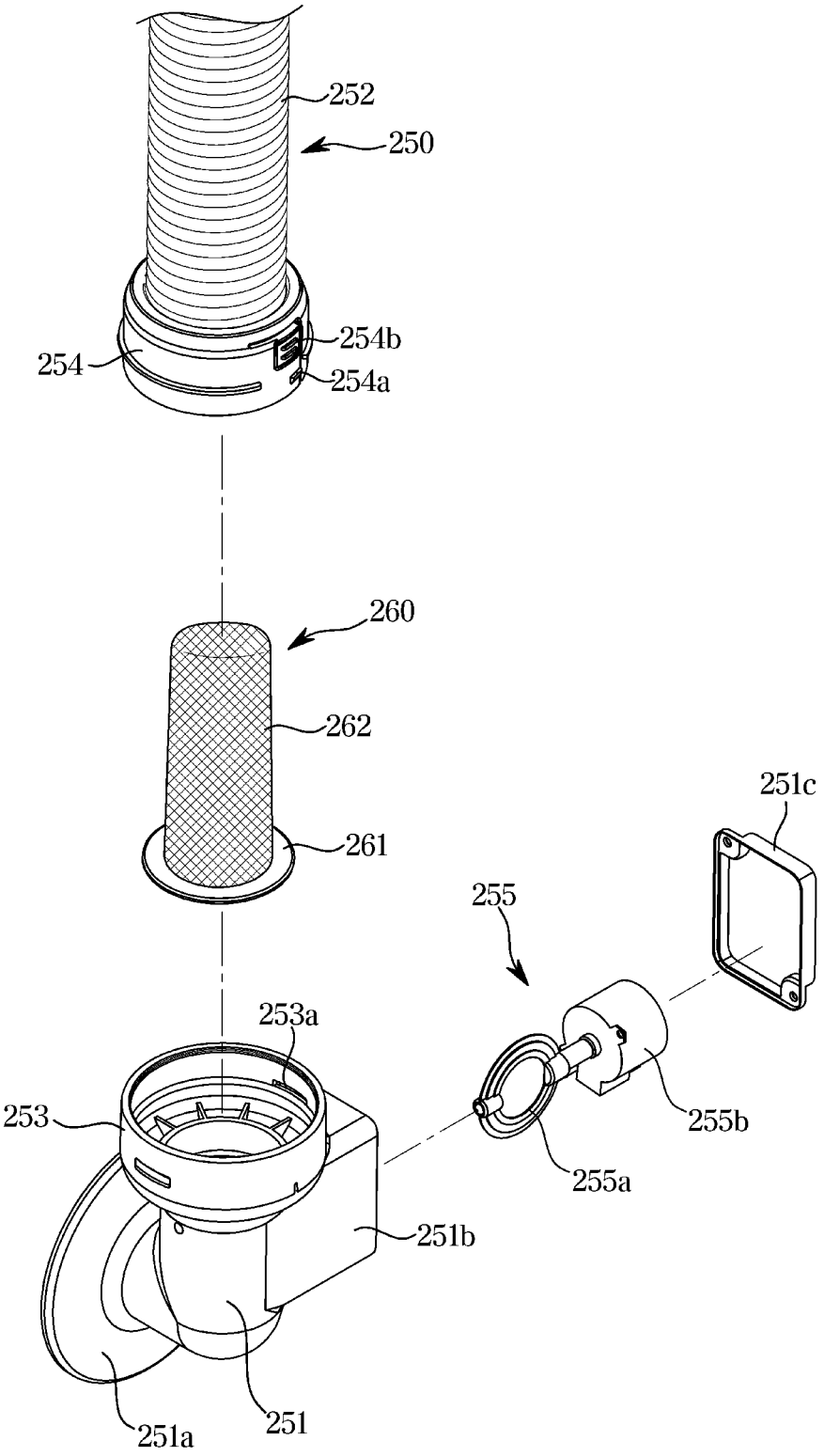
FIG. 7 is an exploded perspective view of the ventilation pipe and the ventilation filter of the ventilation apparatus according to an embodiment of the disclosure.

As illustrated in FIGS. 6 and 7, an opening/closing device 255 configured to open and close an inner flow path may be installed in the inlet tube 251. The opening/closing device 255 may include a circular opening/closing blade 255*a* rotatably installed inside the inlet tube 251 to correspond to an inner diameter of the inlet tube 251, and an opening/closing motor 255*b* configured to rotate the opening/closing blade 255*a*. The inlet tube 251 may include a motor accommodating portion 251*b* provided on an outer side thereof to accommodate the opening/closing motor 255*b*, and a cover 251*c* configured to open and close the motor accommodating portion 251*b*.

The extension tube 252 has a diameter corresponding to the inlet tube 251 and may be a flexible tube capable of being bent. The extension tube 252 extends from the inlet tube 251 side to the case 210 of the ventilation apparatus 200.

The extension tube 252 may include a second connector 254 provided on one end thereof connected to the inlet tube 251 to be connected to the first connector 253. As illustrated in FIGS. 6 and 7, the second connector 254 may be coupled to the first connector 253 by entering into the first connector 253 and then being caught on the first connector 253. For such coupling, a locking groove 253*a* may be provided on an inner surface of the first connector 253 and a locking protrusion 254*a* may be provided on an outer surface of the second connector 254 to be caught on the locking groove 253*a*. The second connector 254 may include a release button 254*b* provided to release the locking of the locking protrusion 254*a* so that the second connector 254 may be separated from the first connector 253 when necessary.

Referring to FIG. 4, the inlet 211 of the case 210 and the opposite end of the extension tube 252 may also be connected in a manner in which the inlet tube 251 and the extension tube 252 are connected. A third connector 257 identical to the first connector 253 may be provided on the inlet 211 of the case 210 to which the extension tube 252 is connected, and a fourth connector 258 identical to the second connector 254 may be provided on the extension tube 252.

Referring to FIGS. 6 and 7, the ventilation filter 260 may include a support part 261 supported on a connection portion between the inlet tube 251 and the extension tube 252, and an air filtering part 262 extending from the support part 261 in a direction in which air flows and formed in a cup shape.

The support part 261 may be formed in a ring shape and may be coupled by being interposed between the first connector 253 and the second connector 254 when the second connector 254 is connected to the first connector 253.

The air filtering part 262 may be installed to be inserted into the extension tube 252 in a state in which an opening side thereof is coupled to the support part 261. The air filtering part 262 may be formed in a mesh shape made of a metal or resin material and may be provided in a cup or pocket type to accommodate the filtered foreign substances in an internal space thereof. The air filtering part 262 may also include a porous material such as a nonwoven fabric or a sponge.

As illustrated in FIG. 6, the air filtering part 262 may have a length L1 longer than an inner diameter D1 of the extension tube 252 and may have a shape in which a diameter thereof gradually decreases from the support part 262 toward the flow direction of air (a lengthwise direction of the extension tube). The air filtering part 262 may have a cylindrical shape in which the diameter thereof gradually decreases from the support part 262 toward the inside of the extension tube 252.

As illustrated in FIG. 6, the air filtering part 262 having a shape in which the diameter thereof gradually decreases may secure a sufficient flow path because an outer surface thereof is spaced apart from an inner surface of the extension tube 252, so that air passed through the air filtering part 262 may flow smoothly.

As such, because a surface area (filtration area) of the air filtering part 262 is much larger than a cross-sectional area of the extension tube 252, foreign substances in air may be easily filtered out while a flow resistance of air passing through the ventilation pipe 250 may be minimized. In addition, because the filtration area may be increased while a volume of the ventilation filter 260 may be reduced so that the ventilation filter 260 may be accommodated in the ventilation pipe 250, a dust collection capacity may be increased.

The ventilation filter 260 is installed inside a connection portion between the inlet tube 251 positioned upstream of the ventilation pipe 250 and the extension tube 252, so that contamination of the extension tube 252 by dust and the like introduced from the outside may be minimized. The inside of the extension tube 252 having a relatively long length may be prevented from being contaminated from dust or the like.

The ventilation filter 260 is installed to be inserted into the ventilation pipe 250 through the connection portion between the inlet tube 251 and the extension tube 252, so that maintenance such as cleaning and replacement of the ventilation filter 260 is easy. Because a user may take out the ventilation filter 260 only by separating the extension tube 252 from the inlet tube 251, maintenance of the ventilation filter 260 is easy.

FIG. 6 illustrates the cylindrical ventilation filter 260 in which the diameter thereof gradually decreases toward the flow direction of air, but the ventilation filter 260 is not limited thereto, and the shape of the air filtering part 262 may be variously changed, such as a polygonal pyramid shape, a cone shape, and a hemispherical shape.

Figure 8:
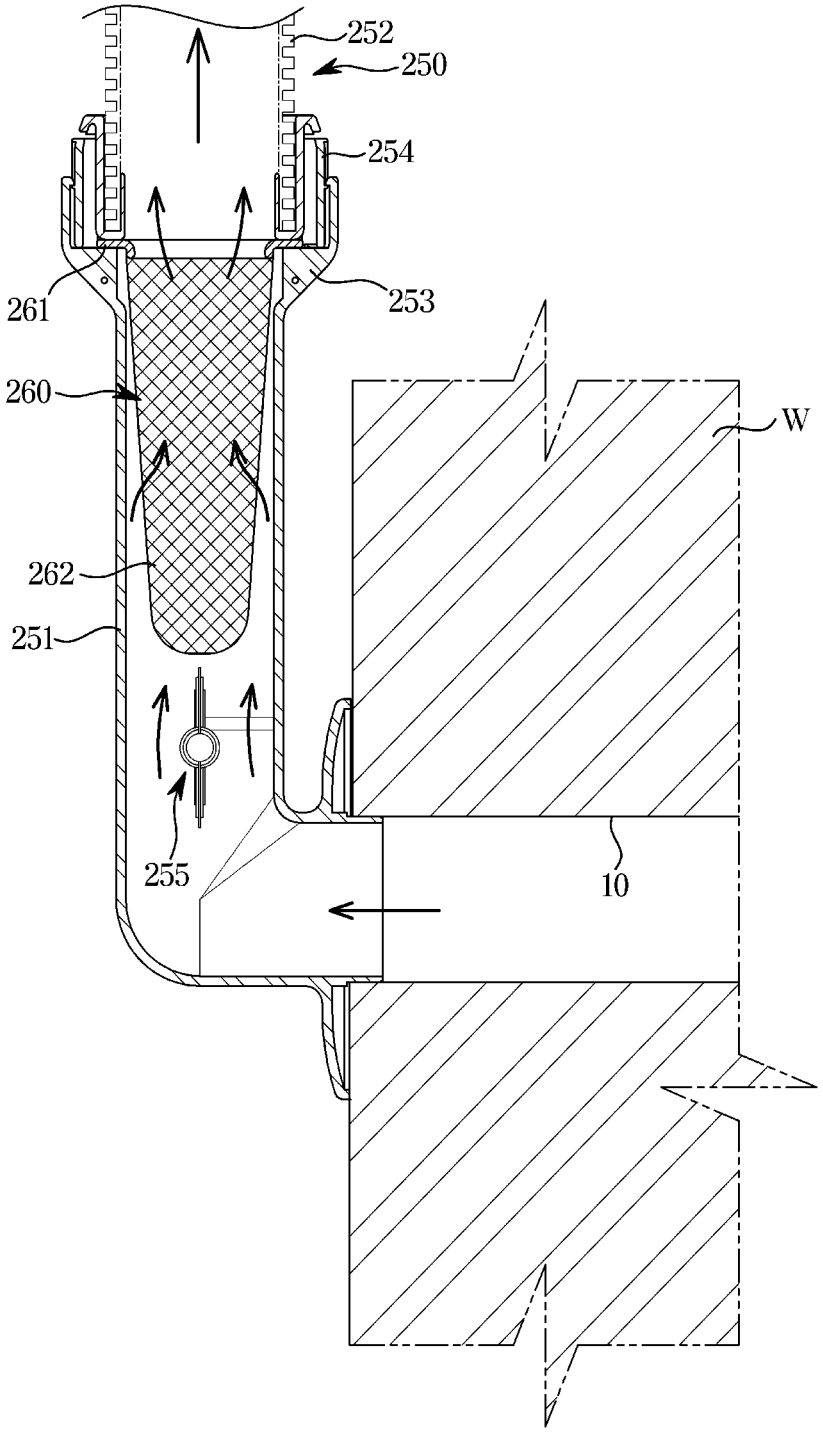
FIGS. 8 to 10 illustrate modified examples of a ventilation filter installation method of the ventilation apparatus according to an embodiment of the disclosure.
Figure 9:
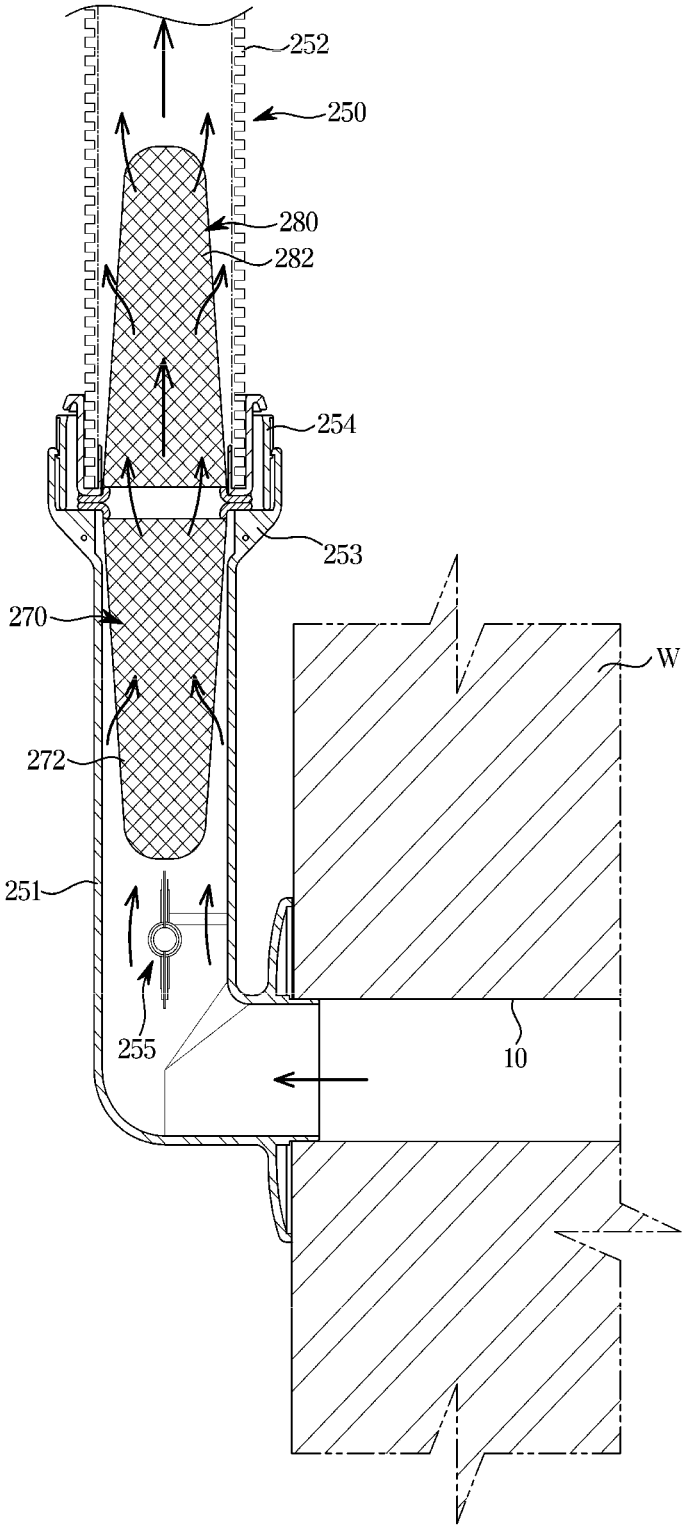
Figure 10:
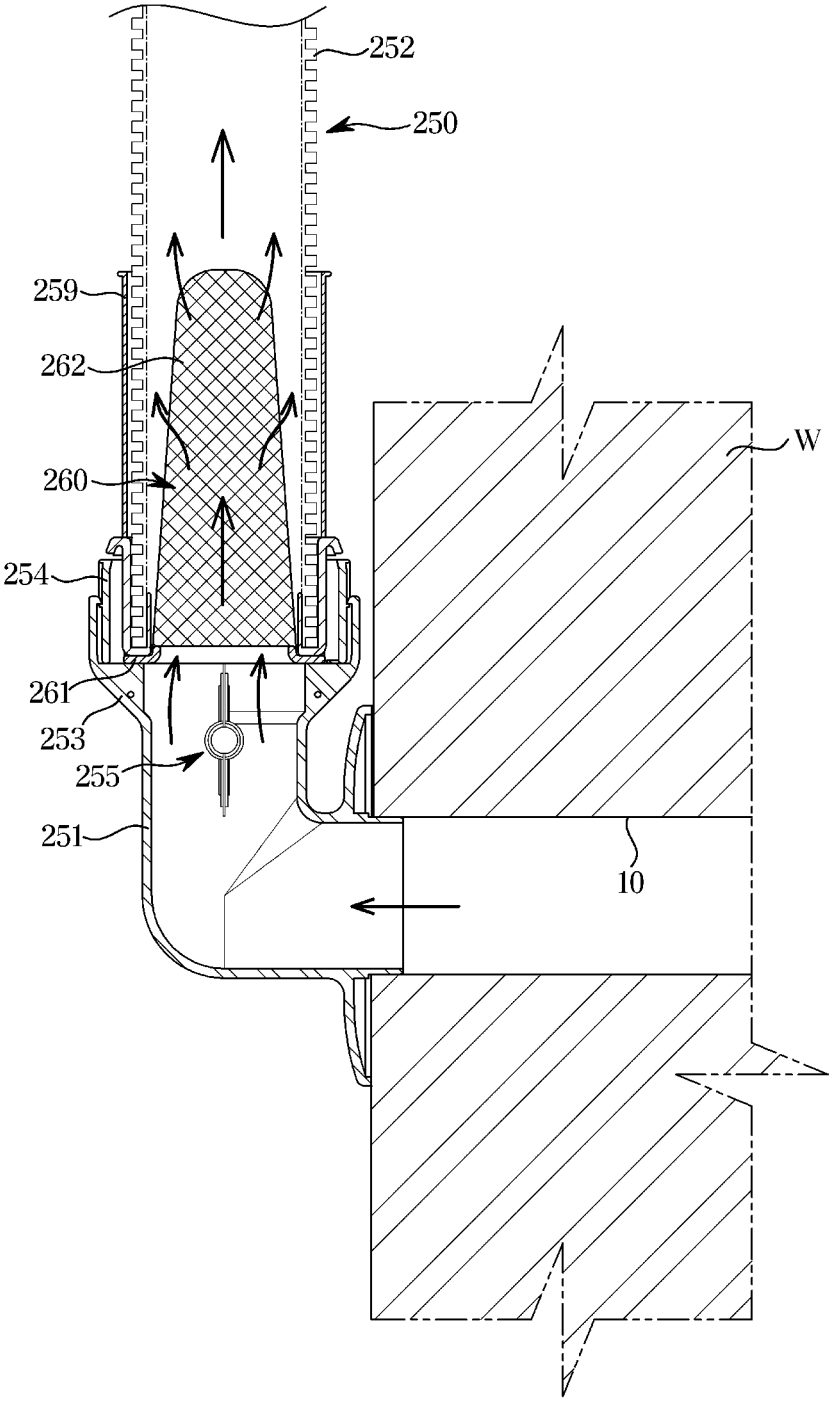

FIGS. 8 to 10 illustrate modified examples of a ventilation filter installation method.

FIG. 8 illustrates that the inlet tube 251 is provided longer, and the air filtering part 262 of the ventilation filter 260 is installed to be inserted into the inlet tube 251. As such, even when the ventilation filter 260 is installed opposite to the example of FIG. 6, substantially the same effect as the above-described example may be exhibited in the air supply mode or the exhaust mode of the ventilation apparatus 200.

FIG. 9 illustrates that two of ventilation filters 270 and 280 are installed in the ventilation pipe 250. FIG. 9 illustrates the first ventilation filter 270 installed such that an air filtering part 272 is inserted into the inlet tube 251 and the second ventilation filter 280 installed such that an air filtering part 282 is inserted into the extension tube 252. The first ventilation filter 270 and the second ventilation filter 280 may be designed to have different air filtration conditions. For example, the first ventilation filter 270 may filter out foreign substances having relatively large particles, and the second ventilation filter 280 may filter out foreign substances having relatively small particles.

FIG. 10 illustrates that a protective tube 259 is disposed outside the extension tube 252 to protect the ventilation filter 260 inserted into the extension tube 252. Because the extension tube 252 is a flexible tube, the extension tube 252 may interfere with the air filtering part 262 of the ventilation filter 260 when bent. However, because the protective tube 259 illustrated in FIG. 10 supports the extension tube 252 outside the air filtering part 262, the extension tube 252 may be prevented from being deformed toward the air filtering part 262. The protective tube 259 may have a cylindrical shape supporting the outside of the extension tube 252, and one end thereof may be connected to the second connector 254.

FIGS. 11 to 14 illustrate modified examples of the ventilation filter.

Figure 11:
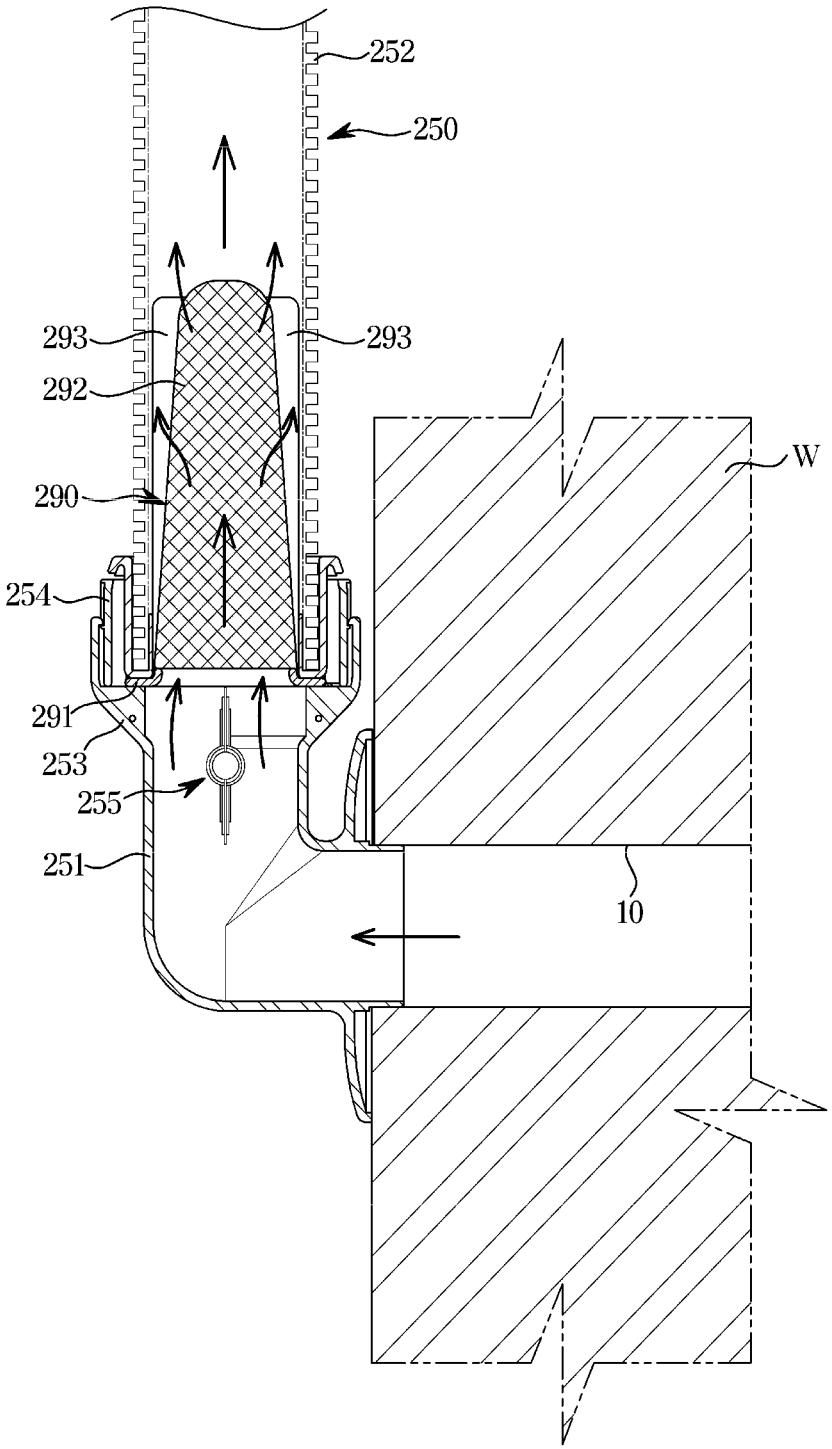
FIGS. 11 to 14 illustrate modified examples of the ventilation filter employed in the ventilation apparatus according to an embodiment of the disclosure.
Figure 12:
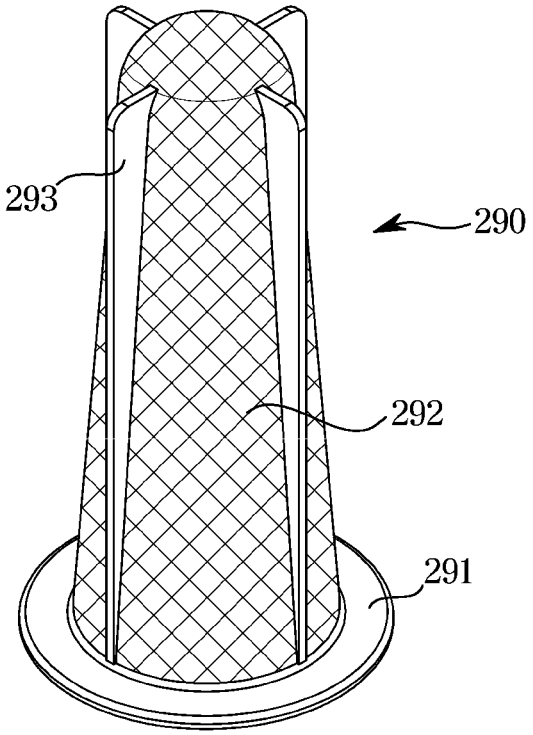

As illustrated in FIGS. 11 and 12, a ventilation filter 290 may include a support part 291, an air filtering part 292, and a plurality of support ribs 293 provided on an outer surface of the air filtering part 292. The plurality of support ribs 293 extends radially from the outer surface of the air filtering part 292 and is supported on the inner surface of the extension tube 252. The plurality of support ribs 293 extends long also in a lengthwise direction of the air filtering part 292.

As illustrated in FIG. 11, the plurality of support ribs 293 maintains a state in which an outer surface of the air filtering part 292 and an inner surface of the extension tube 252 are spaced apart from each other, so that air passing through the air filtering part 292 may flow smoothly through the ventilation pipe 250.

The plurality of support ribs 293 may prevent deformation of the air filtering part 292 by increasing a bending stiffness of the air filtering part 292, and may prevent bending of the extension tube 252 in a region where the air filtering part 292 is located by supporting the inner surface of the extension tube 252.

Figure 13:
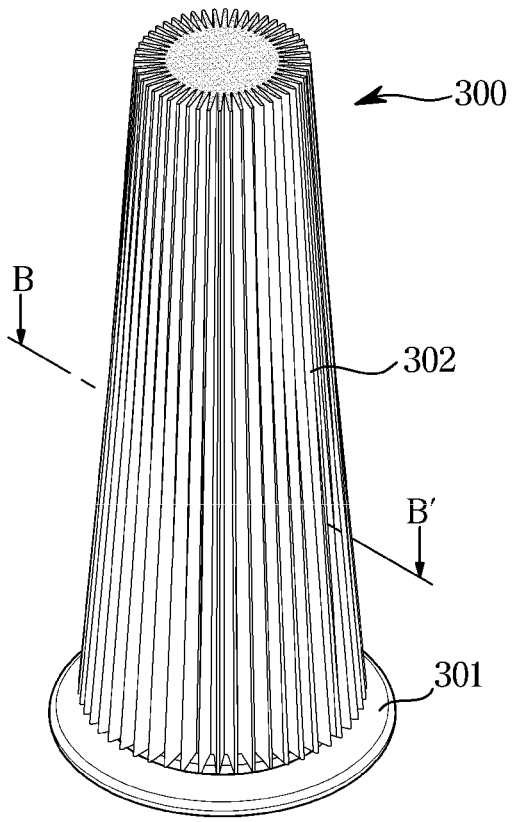
Figure 14:
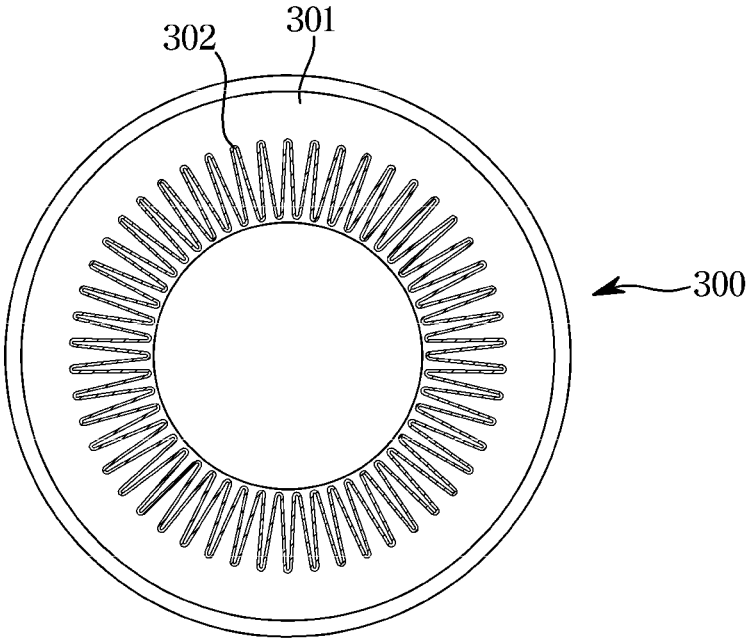

Referring to FIGS. 13 and 14, a ventilation filter 300 includes a support part 301 and an air filtering part 302, and the air filtering part 302 may include a plurality of pleats formed in a circumferential direction such that a plurality of valleys is formed in a lengthwise direction. FIG. 14 is a cross-sectional view taken along line B-B' in FIG. 13. The pleated air filtering part 302 may significantly increase a filtration area through which air passes. Therefore, the ventilation filter 300 may easily filter out foreign substances in air while minimizing the flow resistance of air passing through the ventilation pipe 250.

Figure 15:
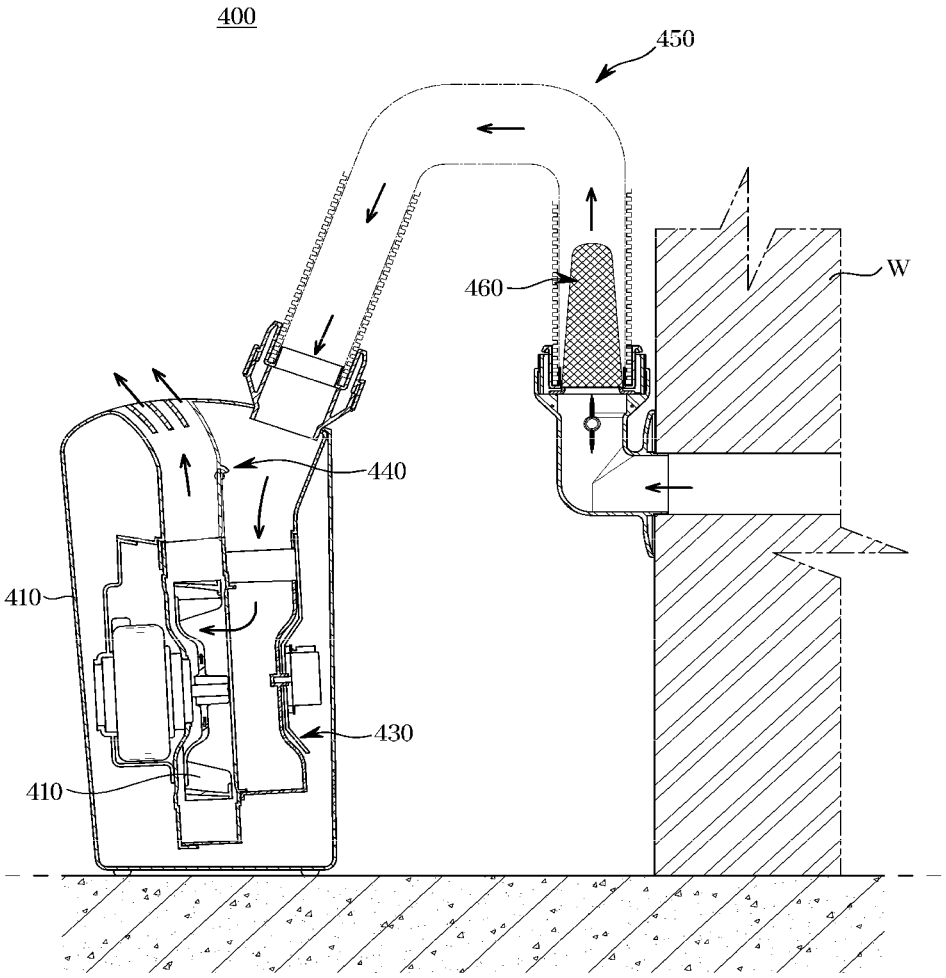
FIG. 15 is a cross-sectional view of a ventilation apparatus according to an embodiment of the disclosure.

FIG. 15 is a cross-sectional view of a ventilation apparatus 400 according to a second embodiment of the disclosure. The ventilation apparatus 400 according to the second embodiment may ventilate a room in a state of being installed separately from the main body 100 of the air conditioner.

The ventilation apparatus 400 may include a case 410 forming an outer shape, a ventilation fan 420 installed inside the case 410, a ventilation motor 422, a first flow path switching device 430, a second flow path switching device 440, a ventilation pipe 450, and a ventilation filter 460. The ventilation fan 420, the ventilation motor 422, the first flow path switching device 430, the second flow path switching device 440, the ventilation pipe 450, and the ventilation filter 460 may be configured substantially the same as in the first embodiment.

As is apparent from the above, in a ventilation apparatus according to an embodiment of the disclosure and an air conditioner including the same, a ventilation filter is installed inside a connection part between an inlet tube located upstream of a ventilation pipe and an extension tube, so that contamination of the ventilation pipe by dust and the like introduced from the outside can be minimized. That is, contamination of the inside of the extension tube having a relatively long length by dust and the like can be prevented.

Further, in the ventilation apparatus according to an embodiment of the disclosure and the air conditioner including the same, a filtration area of an air filtering part of a ventilation filter is much larger than a cross-sectional area of the ventilation pipe, so that foreign substances in air can be easily filtered out while a flow resistance of air passing through the ventilation pipe can be minimized. In addition, the filtration area can be increased while a volume of the ventilation filter can be reduced so that the ventilation filter can be accommodated in the ventilation pipe, so that a dust collection capacity can be increased.

Further, in the ventilation apparatus according to an embodiment of the disclosure and the air conditioner including the same, the ventilation filter is installed to be inserted into the ventilation pipe through the connection portion between the inlet tube and the extension tube, so that maintenance such as cleaning and replacement of the ventilation filter is easy.

While the disclosure has been particularly described with reference to exemplary embodiments, it should be understood by those of skilled in the art that various changes in form and details may be made without departing from the spirit and scope of the disclosure.

What is claimed is:

1. An air conditioner comprising:

a main body including a heat exchanger and a first fan to move indoor air to pass through the heat exchanger; and a ventilation apparatus mountable on the main body to ventilate a room, wherein the ventilation apparatus comprises:

a case configured to accommodate a second fan;

a ventilation pipe including an inlet tube having a first end mountable to an outdoor air inlet formed in a building wall and a second end opposite to the first end so as to be positioned away from the building wall while the first end is mounted to the outdoor air inlet, and an extension tube to connect to the inlet tube at the second end of the inlet tube to thereby form a flow path between the case and the inlet tube, the extension tube being detachable from the inlet tube; and a ventilation filter installable in the ventilation pipe through a connection portion between the inlet tube and the extension tube to filter out substances in air introduced through the outdoor air inlet, the ventilation filter including a support part having an outer diameter larger than inner diameters of the inlet tube and the extension tube.

2. The air conditioner according to claim 1, wherein the ventilation filter comprises:

an air filtering part, in a cup shape, configured to extend along a flow direction of the air from the support part, and the support part is configured to be supported on the connection portion between the inlet tube and the extension tube.

3. The air conditioner according to claim 2, wherein the air filtering part gradually decreases in diameter toward the flow direction of the air from the support part.

4. The air conditioner according to claim 3, wherein the extension tube is provided as a flexible tube, and the air filtering part comprises a plurality of support ribs extending radially from an outer surface thereof to be supported on an inner surface of the extension tube.

5. The air conditioner according to claim 2, wherein the air filtering part has a length longer than an inner diameter of the extension tube.

6. The air conditioner according to claim 2, further comprising:

a first connector provided at an end of the inlet tube; and a second connector provided at an end of the extension tube to be connected to the first connector.

7. The air conditioner according to claim 6, wherein the support part is interposed between the first connector and the second connector.

8. The air conditioner according to claim 6, wherein the extension tube is provided as a flexible tube, and the air conditioner further comprises a protective tube provided outside the extension tube to prevent deformation of the extension tube outside the air filtering part and connected to the second connector.

9. The air conditioner according to claim 2, wherein the air filtering part has pleats formed in a circumferential direction so that a plurality of valleys is formed in a lengthwise direction.

10. The air conditioner according to claim 2, wherein the ventilation filter comprises a first ventilation filter and a second ventilation filter, the first ventilation filter is installed such that the air filtering part of the first ventilation filter is inserted into the inlet tube, and the second ventilation filter is installed such that the air filtering part is inserted into the extension tube.

11. A ventilation apparatus comprising:

a fan configured to suck outdoor air to be supplied to a room;

a case configured to accommodate the fan and provided with a flow path to which the fan is connected;

a ventilation pipe including an inlet tube mountable to an outdoor air inlet, and an extension tube to connect the flow path and the inlet tube, the extension tube being detachable from the inlet tube; and first and second ventilation filters installable in the ventilation pipe through a connection portion between the inlet tube and the extension tube to filter out substances in air introduced through the outdoor air inlet;

wherein the first ventilation filter includes a first air filtering part, in a cup shape, installable such that the first air filtering part is inserted into the inlet tube to extend in a direction opposite to a flow direction of the air, and the second ventilation filter includes a second air filtering part, in a cup shape, installable such that the second air filtering part is inserted into the extension tube to extend along the flow direction of the air.

12. The ventilation apparatus according to claim 11, wherein each of the first ventilation filter and the second ventilation filter includes:

a support part configured to be supported on the connection portion between the inlet tube and the extension tube.

13. The ventilation apparatus according to claim 12, wherein the air filtering part gradually decreases in diameter toward the flow direction of the air from the support part.

14. The ventilation apparatus according to claim 13, wherein the extension tube is provided as a flexible tube, and the air filtering part comprises a plurality of support ribs extending radially from an outer surface thereof to be supported on an inner surface of the extension tube.

15. The ventilation apparatus according to claim 12, further comprising:

a first connector provided at an end of the inlet tube; and a second connector provided at an end of the extension tube to be connected to the first connector.

16. The ventilation apparatus according to claim 15, wherein the support part is interposed between the first connector and the second connector.

17. The ventilation apparatus according to claim 15, wherein the air filtering part has pleats formed in a circumferential direction so that a plurality of valleys is formed in a lengthwise direction.

18. The ventilation apparatus according to claim 15, wherein the extension tube is provided as a flexible tube, and the air conditioner further comprises a protective tube provided outside the extension tube to prevent deformation of the extension tube outside the air filtering part and connected to the second connector.

19. A ventilation apparatus comprising:

a fan configured to suck outdoor air to be supplied to a room;

a case configured to accommodate the fan and provided with a flow path to which the fan is connected;

a ventilation pipe including an inlet tube mountable to an outdoor air inlet, and an extension tube to connect the flow path and the inlet tube, the extension tube being detachable through the outdoor air inlet; and a ventilation filter including a cup-shaped air filtering part having an opening side supported in the ventilation pipe and extending in a flow direction of air in the ventilation pipe, wherein the ventilation filter comprises a first ventilation filter and a second ventilation filter, and the first ventilation filter is installed such that the cup-shaped air filtering part of the first ventilation filter is inserted into the inlet tube and the second ventilation filter is installed such that the cup-shaped air filtering part of the second ventilation filter is inserted into the extension tube.

* * * * *